US007213966B2

(12) United States Patent
Lambert et al.

(10) Patent No.: US 7,213,966 B2
(45) Date of Patent: May 8, 2007

(54) COLLET WITHOUT DEFORMATION OF THE FIXATION RADIUS OF THE BALANCE-SPRING AND MANUFACTURING METHOD OF THE SAME

(75) Inventors: Roger Lambert, Neuchâtel (CH); Raymond Gabus, Le Locle (CH); Pierre-André Bühler, Orvin (CH); Marco Verardo, Les Bois (CH); Jean-Luc Bazin, Publier (FR)

(73) Assignee: Nivarox-Far SA., Le Locle (CH)

( * ) Notice: Subject to any disclaimer, the term of this patent is extended or adjusted under 35 U.S.C. 154(b) by 210 days.

(21) Appl. No.: 11/094,080

(22) Filed: Mar. 31, 2005

(65) Prior Publication Data

US 2005/0219957 A1 Oct. 6, 2005

(30) Foreign Application Priority Data

Apr. 6, 2004 (EP) ..... 04008293

(51) Int. Cl.
*G04B 17/04* (2006.01)

(52) U.S. Cl. ..... 368/177; 368/175

(58) Field of Classification Search ..... 368/177, 368/175, 127, 176, 178, 128–133, 325
See application file for complete search history.

(56) References Cited

U.S. PATENT DOCUMENTS 2,529,807 A * 11/1950 Marti ..... 368/177
2,698,509 A * 1/1955 Van Valkenburgh et al. ..... 368/175
3,224,183 A * 12/1965 Challacombe et al. ..... 368/175
3,364,673 A * 1/1968 Boult ..... 368/177
3,429,120 A 2/1969 Charpilloz
3,430,435 A * 3/1969 Dumont ..... 368/177
3,630,016 A * 12/1971 Fujihira ..... 368/170
3,896,614 A * 7/1975 Bachmann ..... 368/175
4,215,532 A * 8/1980 Perrot ..... 368/168
4,661,212 A 4/1987 Ehrfeld et al.

(Continued)

FOREIGN PATENT DOCUMENTS

CH 311 287 1/1956

(Continued)

*Primary Examiner*—Vit Miska
*Assistant Examiner*—Sean Kayes
(74) *Attorney, Agent, or Firm*—Sughrue Mion, PLLC

(57) ABSTRACT

The collet is formed by a metal band (10) whose inner contour (11) delimits the recesses (11*a*, 11*b*, 11*c*) for driving the collet onto a balance staff (2) and whose outer contour (12) includes a function point (4) between the collet and the balance spring (9) located at the end of an arm (14) at a distance R from the centre 0 of the staff (2) greater than that of any other point (6, 8, 13, 15, 17) of the outer contour (12). It is characterised in that the inner contour (11) includes a discrete number of points of contact (1, 3, 5, 7) with the staff (2) distributed along identical or different angular apertures α and in that width "I" of the band (10) varies such that the compression forces of the contact points (1, 3, 5, 7) on the staff (2) do not substantially alter the distance R after driving in, leading to a friction torque allowing angular orientation of the collet on the staff (2) and not introducing any unbalance.

8 Claims, 2 Drawing Sheets

U.S. PATENT DOCUMENTS

| | | | | |
|---|---|---|---|---|
| 6,431,746 | B1 * | 8/2002 | Jujo et al. | 368/127 |
| 6,441,516 | B1 * | 8/2002 | Kaelin et al. | 310/36 |
| 6,520,674 | B1 * | 2/2003 | Tokoro | 368/127 |
| 6,554,468 | B1 * | 4/2003 | Manaka et al. | 368/127 |
| 2001/0038803 | A1 | 11/2001 | Morales et al. | |
| 2002/0115016 | A1 | 8/2002 | Warren | |

FOREIGN PATENT DOCUMENTS

| | | | |
|---|---|---|---|
| CH | 347 142 | | 7/1960 |
| CH | 466 807 | | 1/1969 |
| CH | 508 914 | | 12/1970 |
| CH | 508 233 | | 7/1971 |
| DE | 71 12 818 | | 4/1973 |
| EP | 1 302 821 | A2 | 4/2003 |
| FR | 2 312 810 | | 12/1976 |
| FR | 2 386 850 | | 11/1978 |

* cited by examiner

COLLET WITHOUT DEFORMATION OF THE FIXATION RADIUS OF THE BALANCE-SPRING AND MANUFACTURING METHOD OF THE SAME

This application claims priority from European Patent Application No. 04008293.5 filed Apr. 6, 2004, the entire disclosure of which is incorporated herein by reference.

FIELD OF THE INVENTION

The present invention concerns a collet without deformation of the radius of fixation of the balance spring for fixing the inner terminal curve of a balance spring, and also able to be incorporated in an assembly of a balance spring pinned up to the collet in a single piece. The invention also concerns a method for obtaining such a collet and the incorporation thereof in an assembly pinned up to the collet in a single piece.

BACKGROUND OF THE INVENTION

In a mechanical watch movement, the collet forms an assembly interface of the balance spring to the balance. Originally, it was a washer driven onto the balance staff and comprising at least one hooking point of the inner terminal curve of the balance spring, for example by using a conical pin, by bonding or by welding. As welding, in particular laser welding is the preferred method of fixing, the collet can be made of steel, and more particularly special steels incorporating variable proportions of Ni, Mo, Co or Cr. The collet must first of all be of small dimensions so as to have only a slight influence on the moment of inertia, and so as not to introduce any unbalance, but many other properties are expected from such a small part to contribute to the regular working of the regulating member. It is for example necessary, after driving the collet onto the balance staff, to be able to rotate it without any difficulty in order to put the watch into beat, i.e. to align the impulse pin and the line of centres between the balance and the pallet-staff at the position of rest. It is also desirable for the driving in of the collet to have as little as influence as possible on keeping a given distance between the balance staff and the hooking point and that the external contour of the collet is such that it does not disturb the active length of the inner terminal curve of the balance spring.

Numerous Patents filed in the 1960s and 1970s provide a solution to certain quality criteria listed hereinbefore, but no collet possesses all of the qualities required at the same time, as explained briefly hereinafter.

When the collet is made of special steel, the friction torque on the balance staff after driving in can be too great and can make it difficult to put the watch into beat. In order to overcome this drawback, the first solution consists in making a slot of elasticity between the staff hole and the edge of the collet as described for example in CH Patent No. 347 142 for a collet with a perfectly circular contour on which the balance spring is fixed by means of a conical pin located in the plane of symmetry passing through the axes and the slot. CH Patent No. 508 233 discloses a collet of the same type, with a balance spring riveted or bonded in a groove, but of asymmetrical racket shape with the staff hole offset, such that the risk of the first coil pressing on the contour of the collet is avoided. These slotted collets with a circular staff hole have, however, two drawbacks. When driven onto the balance staff, the movement of the hooking point cannot be rigorously controlled, and when the watch is put into beat there is a high risk of disturbing the flat and the centring. In order to reduce the friction torque facilitating putting the watch into beat without having to make a slot, U.S. Pat. No. 3,429,120 proposes making a collet in two parts comprising an inner ring made of brass, or other non-ferrous material, and an external steel part for welding the inner terminal curve of the balance spring. The results obtained are technically satisfactory but the manufacturing and assembling costs are prohibitive.

In order to reduce the friction torque in a special steel collet without a slot of elasticity, it seems a priori logical to reduce the friction surface to discrete contacts between the balance staff and the driving aperture of the collet. The method disclosed in CH Patent No. 311 287 consists in ovalising a hole, which initially has a circular shape, the contour of the collet keeping its initial circular shape. Since there are consequently only two symmetrical bearing points, the same problems as those referred to above for the slotted collet are again experienced.

CH Patent No. 466 807 and U.S. Pat. No. 3,430,435 propose giving the driving aperture of the collet a regular polygonal shape illustrated by an equilateral triangle with broken angles, or an aperture of hypocycloidal shape. In this embodiment it will be observed that the points where the collet is tight on the staff have angular equidistribution and that the collet has almost necessarily a regular contour inscribed in a circle, in particular so as to avoid having problems of unbalance, but having by way of counterpart, the drawback of having a risk of contact of the inner coil of balance spring.

SUMMARY OF THE INVENTION

The invention thus concerns a collet whose particular shape allows there to be no change to the radius of fixation of the balance spring after driving in, guaranteeing perfect centring without any unbalance. This allows optimum driving in force and holding torque, without too much locking on the balance staff, so as to facilitate the subsequent operation of putting the watch into beat, or disassembly. The invention also concerns a balance spring assembly pinned up to the collet and a method of manufacturing the collet and the balance spring assembly pinned up to the collet.

The invention therefore concerns a collet formed by a metal band whose inner contour delimits an aperture for driving said collet onto the balance staff and whose external contour comprises a function point between the collet and the balance spring located at the end of an arm at a distance R from the centre 0 of the staff greater than that of any other point of the external contour. The collet is characterised in that the inner contour comprises a discrete number of points of contact (1, 3, 5) with the staff (2), one of the points (3) being aligned with the staff (2) and the function point (4), the angular apertures a of said function points not all being identical, and in that the band portions (10) substantially opposite the points of contact (3, 5) that are not aligned with the staff (2) and the function point (4) form loops (16, 18) of larger width $I_6$, $I_8$ than the other parts of the band (10).

In the preferred embodiment, the collet has symmetry along an axis x x' passing through the centre 0 of the balance staff and through the function point between the collet and the balance spring, and the inner contour of the band comprises three points of contact, one of them being diametrically opposite the function point between the collet and the balance spring, the two other points having, with respect to the first point angular apertures greater than 90°. As will be seen in the following detailed description, the metal band forming the collet can have the shape of a strip of unequal width, or a much more solid racket shape, whose aperture for driving onto the staff has an ovalised shape.

A collet according to the invention can be obtained in accordance with known stamping methods, but according to a preferred method, particularly for a strip-shaped band, a Liga technique is used, which has the advantage of allowing the collet and the balance spring to be formed simultaneously in a single piece, and thereby providing even greater control of the value of R.

BRIEF DESCRIPTION OF THE DRAWINGS

Other features and advantages of the present invention will appear more clearly in the description of various example embodiments, given by way of non-limiting illustration, with reference to the annexed drawings, in which.

DETAILED DESCRIPTION OF THE INVENTION

Figure 1:
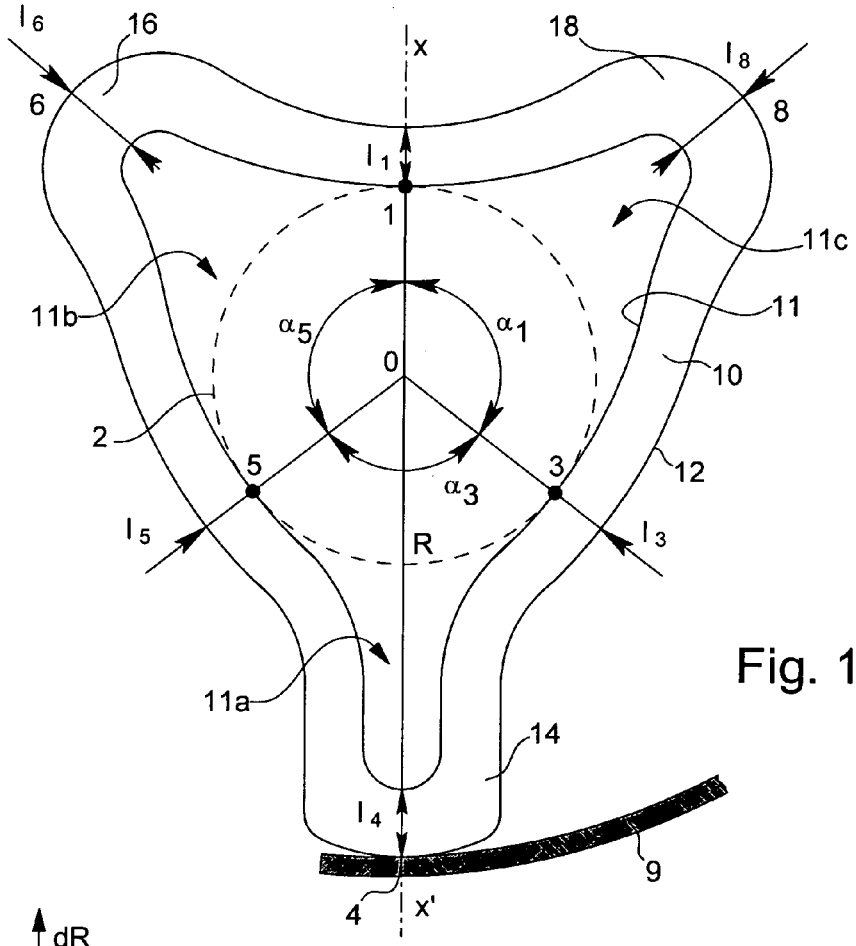
FIG. 1 shows a first embodiment of a collet according to the invention.

FIG. 1 shows a large-scale top view of a first embodiment of a collet according to the invention made of special steel, for example steel or nickel and having a uniform thickness of the order of 0.2 mm. This collet is intended to be driven onto a balance staff 2 (shown in dotted lines) of centre 0. As can be seen, the collet is continued by a continuous band 10 whose inner 11 and outer 12 contours have a particular shape, the width "I" of which is not uniform at all the points of band 10, and whose inner contour 11 comprises only three points of contact 1, 3, 5 with staff 2 moving away from the latter to form recesses 11*a*, 11*b*, 11*c*.

The band has a first recess 11 a forming an arm 14, the end of which comprises on outer contour 12 a function point 4 at a distance R from the centre 0 of staff 2, and onto which the end of the inner terminal curve of balance spring 9 will be welded.

Distance R, which is the radius of fixation of the balance spring to the collet, corresponds to an essential design feature in that its value should ideally not be altered by the driving operation in order to preserve a perfectly centred balance spring. According to the most demanding standards in the field of horology, the displacement of function point 4 must not be greater than 5 μm and, as will be demonstrated hereinafter, this threshold can be greatly reduced with a collet according to the invention.

The centre 0 of the staff and function point 4 define an axis of symmetry x x' for the collet, i.e. for its outer contour 12 and inner contour 11 abutting on balance staff 2 by three points of contact 1, 3 and 5. A first point of contact 1 is diametrically opposite join point 4 and the two other points of contact 3, 5 are symmetrical with reference to axis x x' with an angular shift with respect to the first point of contact 1 of $\alpha_1$ for the point of contact 3 in the clockwise direction and of $\alpha_5$ for the point of contact in the anti-clockwise direction, angles $\alpha_1$ and $\alpha_5$ having the same value higher than 90°. This thus defines an angular shift $\alpha_3$, whose value is one of the determining factors for the object of the invention, between the symmetrical points of contact 3, 5, as will become clear hereinafter.

If outer contour 12 is now considered, it can be seen that band 10 includes two asymmetrical loops 16, 18 that meet at the three points of contact 1, 3, 5. Loops 16, 18 are substantially diametrically opposite to symmetrical points of contact 3, 5 and delimit symmetrical recesses 11*a*, 11*c*. Ends 6, 8 of loops 16, 18 are located, with respect to the centre 0 of staff 2, at a distance less than radius of fixation R of the balance spring, such that the inner terminal curve of balance spring 9 cannot come into contact with outer contour 12 of the collet during oscillations of the balance.

Given the very small dimensions of the collet, the radius R of the order of 0.5 mm, and very strict construction parameters, it is not immediately apparent in FIG. 1 that, according to another essential feature of the invention, the width "I" of band 10 is not uniform over the entire periphery. In the example shown, the widths $I_1$, $I_3$, $I_5$ at contact points 1, 3, 5 are identical. At the junction point 4, the strip has a width $I_4$ about 15% greater, and at the loops areas 16, 18 widths 30 to 35% greater than $I_1$. It is quite clear that the preceding values are only given by way of example and that they could vary as a function of the material employed and the size of loops 16, 18.

Figure 2:
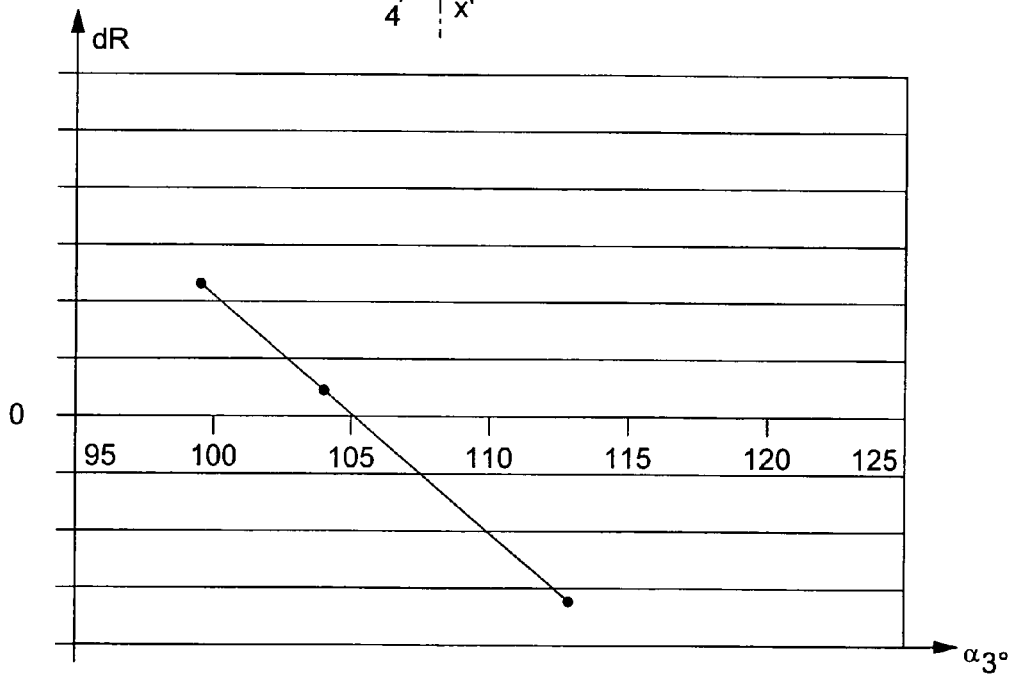
FIG. 2 is a graph giving the displacement of the point of welding the collet shown in FIG. 1 as a function of the angle $\alpha_3$, for a given nominal tightening.

Another feature of a collet according to the invention concerns the value that should be given to angle $\alpha_3$ between the second contact point 3 and third contact point 5 to have a minimum variation dR of radius R. The graph reproduced at FIG. 2 shows the variation of dR as a function of the value of angle $\alpha_3$. According to this graph, it can be seen that the optimum value of $\alpha_3$would be 105°. In reality, for the contour shown in FIG. 3, $\alpha_3$=104° which corresponds to an almost zero displacement dR of function point 4. In other words, such a result is obtained owing to the combination of a particular choice of the contour of band 10, widths "I" at its various points, and angles α between the different contact points with staff 2, such that the resultant of the compression forces on staff 2 is practically zero, while having an asymmetrical collet removing the risk of contact of the inner terminal curve of the balance spring on the collet.

Figure 3:
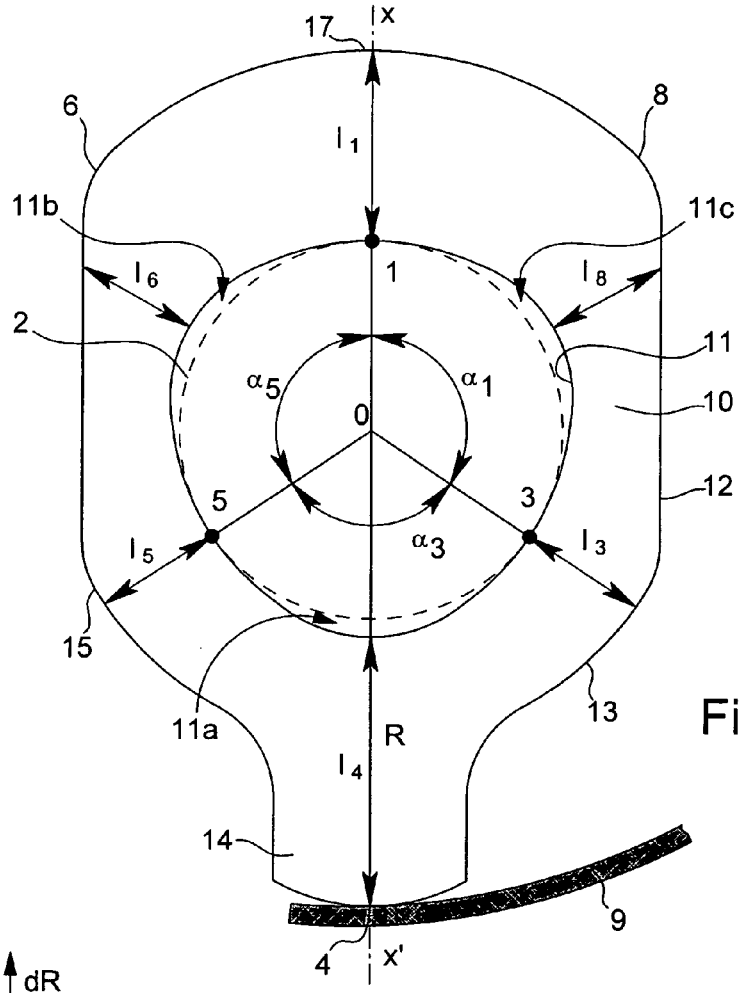
FIG. 3 shows a second embodiment.
Figure 4:
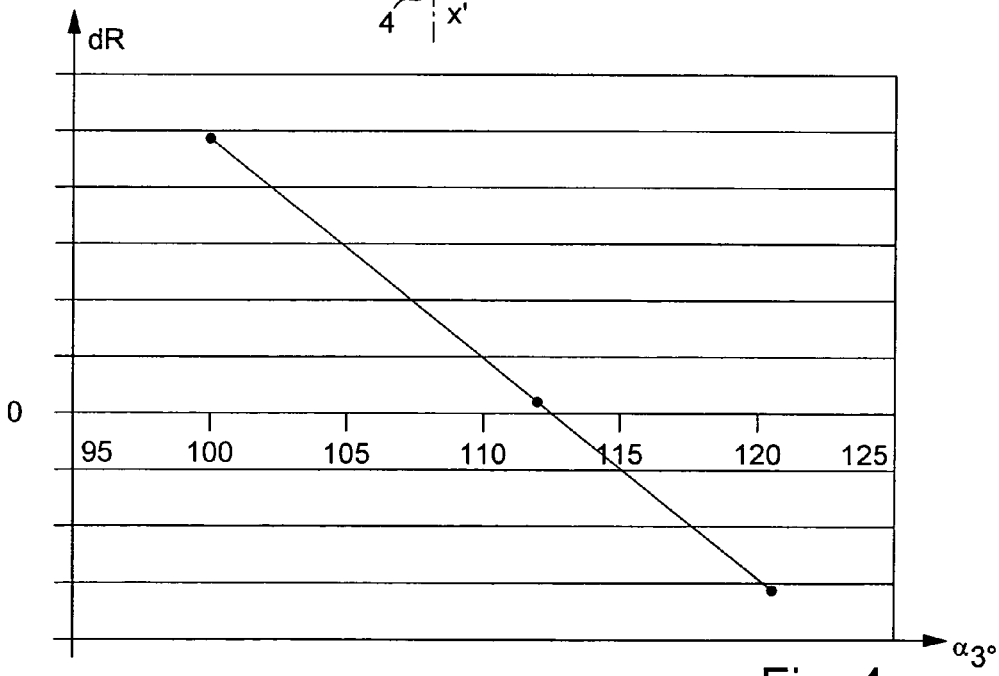
FIG. 4 is a graph giving the displacement of the point of welding of the collet shown in FIG. 3 as a function of the angle $\alpha_3$.

With reference now to FIG. 3, a second embodiment is shown corresponding to a slightly more "solid" design, but which comprises all of the features of the first embodiment. The inner contour 11 of the collet includes three contact points 1, 3, 5 with balance staff 2, having respectively an angular shift $\alpha_1$, $\alpha_3$, $\alpha_3$, but recesses $\mathbf{11}_a$, $\mathbf{11}_b$ and $\mathbf{11}_c$ of inner contour 11 between said contact points are reduced to "non contact " zones. Outer contour 12 has a more regular shape recalling the shape of a racket, function point 4 at the end of arm 14 being likewise located at a distance R from the centre 0 of staff 2 greater than that of all the other points 6, 8, 13, 15 and 17 of said outer contour 12. In this construction, in order to obtain the smallest possible variation dR from radius R, it will be observed that the relative values of the distances $I_1$ to $I_8$ are different from those of the first embodiment. It appears in fact that $I_4>I_1>i_8=I_6=I_5=I_4$. As in the first embodiment, the value that should be given to angle $\alpha_3$ between the two symmetrical contact points 3, 5 is determinant for the resultant of the compression forces on staff 2 to be zero. The graph reproduced at FIG. 4 shows the variation of dR as a function of the value of angle $\alpha_3$. According to this graph, it can be seen that, for the construction shown in FIG. 3 an almost zero value of dR is obtained for an angle $\alpha_3$=112°. These values are given by way of example, since it is quite clear that modifications of the relative values of $I_1$ to $I_8$ could lead to another choice of $\alpha_3$, and even to having $\alpha_1=\alpha_3=\alpha_5$ by acting solely on the shape of the collet to have a zero resultant of the compression forces on staff 2, while having an arm 14 enabling the inner terminal curve of balance spring 9 to be moved away from the other points of the outer contour of the collet.

The collets according to the invention that have just been described can be manufactured by known stamping methods. However, the preferred method, particularly for the collet of the first embodiment and when the balance spring is integral with the collet, consists in using the LIGA technique that has been known since the middle of the 1970s.

In a first step, the method basically consists in spreading over a substrate that has been previously coated with a sacrificial layer, a positive or negative photoresist over a thickness corresponding to the desired height of the collet and in forming, by means of a mask, via photolithography and chemical etching, a hollow structure corresponding to the desired contour of the collet or the collet-balance spring assembly.

In a second step, said hollow structure is filled with a metal or a metal alloy either by electroplating, as indicated for example in U.S. Pat. No. 4,661,212, or by pressing and sintering nanoparticles, as indicated for example in U.S. patent application Ser. No. 2001/0038803.

In a last step, the collet or the collet-balance spring assembly is released from the substrate by removing the sacrificial layer.

This method further offers the advantage of being able to manufacture in batches and thus reducing the unit cost of the products obtained.

What is claimed is:

1. A collet for mounting a balance spring, said collet being formed by a metal band whose inner contour delimits recesses for driving the collet onto a balance staff and whose outer contour includes a function point between the collet and the balance spring located at the end of an arm at a distance R from the centre 0 of the staff greater than that of any other point of the outer contour, wherein the inner contour includes a discrete number of points of contact with the staff, one of the points being aligned with the staff and the function point, the angular apertures $\alpha$ of said function points not being all identical, and wherein the portions of band substantially opposite the points of contact not aligned with the staff and the join point form function of greater width $I_6$, $I_8$ than the other parts of the band.

2. The collet according to claim 1, wherein it has symmetry along an axis x x' passing through the centre 0 of the staff and through the function point between the collet and the balance spring.

3. The collet according to claim 2, wherein it includes three points of contact of angular apertures $\alpha_1$, $\alpha_3$ and $\alpha_5$ having angular apertures such that $\alpha_1=\alpha_5>90°$.

4. The collet according to claim 3, wherein $\alpha_3>100°$.

5. The collet according to claim 1, wherein the inner contour has an ovalised shape and wherein the outer contour of the band has a rectangular shape with rounded angles extended by the arm including the function point between the collet and the balance spring.

6. The collet according to claim 1, wherein the balance spring is integral with the arm of the metal band.

7. The collet according to claim 1, capable of being manufactured in batches by a method comprising the steps of:

a—spreading over a substrate that has previously been coated with a sacrificial layer, a layer of positive or negative photoresist having the desired thickness of the collet;

b—forming by means of a mask, by photolithography and chemical etching, a hollow structure corresponding to the inner and outer contours of a batch of collets;

c—filling the hollow structure with a metal or a suitable metal alloy by electroplating, and d—releasing the batch of collets by removing the sacrificial layer.

8. The collet according to claim 7, wherein in step "b" the contour of the balance spring is also formed.

* * * * *